US005865695A

United States Patent [19]

Mahala et al.

[11] Patent Number: 5,865,695

[45] Date of Patent: Feb. 2, 1999

[54] TRAINING DEVICE FOR BASKETBALL PLAYERS FOR DEVELOPING PROPER SHOOTING TECHNIQUE

[76] Inventors: Robert Mahala, 850 Howard Ave., Apt. 3D, Staten Island, N.Y. 10301; Mark Qualben, 84 Constant Ave., Staten Island, N.Y. 10314; Peter Meurer, 18 Tom Ct., Staten Island, N.Y. 10310

[21] Appl. No.: 649,216

[22] Filed: May 17, 1996

[51] Int. Cl.[6] ..... A63B 69/00

[52] U.S. Cl. ..... 473/450; 602/16; 602/20

[58] Field of Search ..... 473/450, 447, 473/448; 602/16, 20, 26, 63

[56] References Cited

U.S. PATENT DOCUMENTS

| | | | |
|---|---|---|---|
| D. 351,438 | 10/1994 | Weaver . | |
| D. 353,860 | 12/1994 | Walk | D21/201 |
| 4,191,373 | 3/1980 | Lancellotti . | |
| 4,377,284 | 3/1983 | Okerlin . | |
| 4,383,685 | 5/1983 | Bishop . | |
| 4,433,679 | 2/1984 | Mauldin et al. | 602/16 |
| 4,605,227 | 8/1986 | Hurd et al. . | |
| 4,718,665 | 1/1988 | Airy et al. | 602/16 X |
| 4,919,425 | 4/1990 | Wolf . | |
| 4,953,543 | 9/1990 | Grim et al. | 602/16 |
| 4,984,789 | 1/1991 | Socci . | |
| 5,135,217 | 8/1992 | Swain . | |
| 5,149,085 | 9/1992 | Sanchez . | |
| 5,228,682 | 7/1993 | Wolf . | |
| 5,395,117 | 3/1995 | Ogden | 602/20 X |
| 5,437,619 | 8/1995 | Malewicz et al. | 602/16 X |
| 5,544,877 | 8/1996 | Brownell | 473/450 |
| 5,651,743 | 7/1997 | Stephan et al. | 473/450 |

OTHER PUBLICATIONS

The Bandit™ Shooting and Training Guide, NEBCO, Inc. (undated).

*Primary Examiner*—Raleigh W. Chlu
*Attorney, Agent, or Firm*—Morgan & Finnegan, L.L.P.

[57] ABSTRACT

A training device and method of use thereof to initiate and develop proper shooting technique for basketball players. The device comprises a pair of arm braces that when worn overlay the inside portion of the forearm and upper arm of the shooting arm of the player, a pair of sleeves attached to the arm braces that are adapted to snugly fit around the player's forearm and upper arm, and an interconnecting pivot which allows the arm braces to pivot relative to one another over a predetermined range of motion whereby the forearm is prevented by mechanical resistance from pivoting beyond the point at which it forms a right angle with the upper arm.

13 Claims, 3 Drawing Sheets

TRAINING DEVICE FOR BASKETBALL PLAYERS FOR DEVELOPING PROPER SHOOTING TECHNIQUE

BACKGROUND OF THE INVENTION

This invention relates to a training device to initiate and develop proper shooting technique for basketball players. More particularly, the invention relates to a training device which is adapted to be worn by a basketball player to develop proper form for shooting a basketball, wherein the forearm of the player's shooting arm is prevented by mechanical resistance from moving back towards the player's body beyond the point at which it forms a right angle with the upper arm of the shooting arm, and in which the elbow of the shooting arm is maintained in close lateral proximity to the player's non-shooting arm.

A problem often encountered with basketball players is that of initiating the use of the proper shooting technique which thereafter becomes learned and is automatically followed as the shooting skills of the basketball player are developed. The untrained player has a tendency when shooting a basketball to use an exaggerated motion in which the forearm of the player's shooting arm is brought too far back towards the player's body, the upper arm of the shooting arm is brought up beyond the point at which it is parallel to the ground, and the elbow of the shooting arm is swung laterally away from the player's non-shooting arm. Such an exaggerated motion requires that the player rely too extensively on the wrist action of the shooting arm in projecting the ball toward the basket, which causes the ball to be "thrown" at the basket in an overstated motion and thereby to often follow an inaccurate trajectory.

Although devices for training the basketball player are generally known, most of such devices are complex, bulky and cumbersome. Further, such devices do not train the basketball player to restrict the movement of the forearm of the player's shooting arm in relation to that of the upper arm and to limit the lateral movement of the elbow of the player's shooting arm, while at the same time allowing for proper follow-through of the forearm of the player's shooting arm in propelling the basketball towards the basket. As such, a need exists for an improved device for training basketball players in the proper method of shooting a basketball which emphasizes proper alignment and movement of the shooting arm and is lightweight and not cumbersome when worn by the player.

SUMMARY OF THE INVENTION

It has been found that there is a need among basketball players and coaches alike for a training device for basketball players which initiates and fosters the development of proper shooting form. It has also been found that proper shooting form requires the proper alignment and movement of the player's shooting and non-shooting arms. It has further been found that proper alignment and movement of the player's shooting arm during the shooting motion requires that the forearm be permitted to move back towards the player's body but not beyond the point at which it forms a right angle with the upper arm, that the upper arm be limited from moving up beyond the point at which it is parallel to the ground, and that the elbow of the shooting arm be maintained in close lateral proximity to the non-shooting arm. It has still further been found that if the forearm of the shooting arm is brought back towards the player's body beyond the point at which it forms a right angle with the upper arm, or if the upper arm is raised beyond the point at which it is parallel to the ground, or if the elbow of the shooting arm is allowed to swing laterally away from the non-shooting arm, the player's arm movement will become exaggerated and the basketball may be awkwardly "thrown" at the basket rather than shot at the basket in an accurate trajectory.

The use of proper shooting form significantly increases the player's ability to accurately project the ball toward the basket. The invention provides a device that initiates and fosters the development of proper shooting form by limiting the movement of the forearm and elbow of the player's shooting arm as described above, while at the same time allowing for proper follow-through of the shooting arm towards the basket. With repetition and practice using the invention, proper shooting form will eventually become a learned function and will be followed even after the device is removed from the player's shooting arm.

The development of proper shooting form is accomplished in accord with the invention through the use of a device having a pair of arm braces, each of which is adapted by means of a sleeve attached directly or indirectly thereto, to fit snugly over the forearm and upper arm, respectively, of the player. The arm braces overlay the inside portions of the forearm and upper arm and are securely connected to one another by an interconnecting means. A positive stop is created by mechanical resistance at the point at which the arm brace associated with the forearm when pivoted about the interconnecting means forms a right angle with the arm brace associated with the upper arm. The forearm of the player's shooting arm is thereby prevented during the shooting motion from moving back towards the player's body beyond the point at which it forms a right angle with the upper arm of the player's shooting arm.

One or both of the arm braces may also have means for attaching a strap which is connected at one end to the arm brace and at a second end to the non-shooting arm of the player so as to restrict the lateral movement of the shooting arm, such that the elbow of the player's shooting arm is prevented from swinging away from the non-shooting arm during the shooting motion.

The device possesses the additional attributes of being lightweight and durable, being adaptable to a right or left handed player, being capable of ready and easy installation on the shooting arm of the player, being adjustable for various arm sizes, being safe, and being capable of being worn for either a set shot or jump shot.

Accordingly, it is an object of the present invention to provide a training device for basketball players which is worn by the player and serves to initiate and develop proper shooting technique by limiting the movement of the forearm of the shooting arm to the point at which it forms a right angle with the upper arm, and by maintaining the elbow of the shooting arm in close lateral proximity to the player's non-shooting arm during the shooting motion.

It is a further object of the present invention to provide a training device for basketball players which, while preventing the forearm and elbow of the shooting arm from improper alignment or movement, allows the full extension of the shooting arm in a forward follow-through motion during projection of the basketball towards the basket.

It is a further object of the present invention to provide a training device for basketball players which is lightweight and durable, is readily assembled on the player and is adapted for use either by a right handed or left handed player.

Further objects and advantages of the invention will become apparent from the following description taken in conjunction with the accompanying drawings.

BRIEF DESCRIPTION OF THE DRAWINGS

The novel features which are believed to be characteristic of the invention are set forth with particularity in the appended claims. The invention itself, however, both as to its organization and method of operation, together with further objects and advantages thereof, may best be understood by reference to the following description taken in connection with the accompanying drawings, wherein:

DETAILED DESCRIPTION OF THE INVENTION

Reference is now made to the drawings wherein the training device for initiating and developing the shooting skills of a basketball player is depicted.

Figure 1:
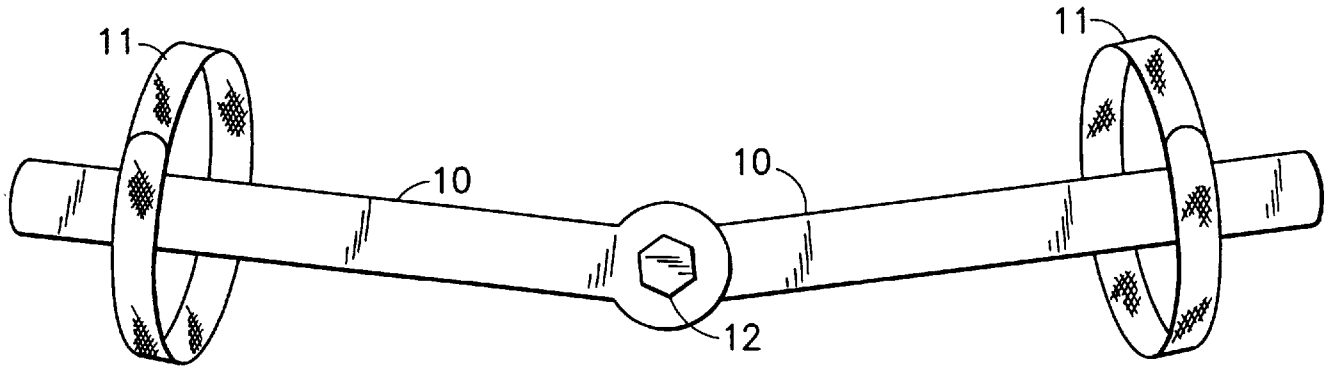
FIG. 1 is an elevated view of the device.

In FIG. 1, a device comprising a pair of arm braces 10, respective stretchable or webbed sleeve components 11 and an interconnecting means 12 is shown.

More particularly, the device comprises a pair of arm braces 10 that are designed so as to overlay the inside portions of the forearm and upper arm of the shooting arm of a basketball player; a pair of sleeves 11, each of which is directly or indirectly attached to each of said arm braces and which is adapted by securing means to snugly fit on the forearm and upper arm portions of the shooting arm of the player; and an interconnecting means 12 that serves to allow the arm braces to pivot over a predetermined range of motion during use of the device.

The arm braces 10 may be prepared from one or more known metal or plastic materials. The arm braces may be of any known type construction, such as "I" beam or square tubular construction. The arm braces are prepared so as to comfortably conform to the respective sizes of the player's forearm and upper arm. Typically, the arm braces are 4 inches to 6 inches long and from 1 inches to 2 inches wide. The arm braces may be of a one-piece or, as more fully described below with regard to the preferred embodiment of FIG. 2, two-piece adjustable construction.

The arm braces are joined at one end by a interconnecting means 12 that allows the arm brace associated with the forearm to pivot over a predetermined range of motion relative to the arm brace associated with the upper arm. The arm braces are prepared such that they provide a positive stop created by mechanical resistance at the point at which the arm brace associated with the forearm forms a right angle with the arm brace associated with the upper arm. At the end of the arm braces adjacent the interconnecting means, the arm braces are tapered in an offset manner to one-half of their overall thickness, such that when they are joined, their combined thickness at the end adjacent the interconnecting means is equal to that of the remaining portion of each individual arm brace. The taper on the arm braces is offset so as to create a mechanical stop by the resistance provided by contact of the arm braces at the point at which they form a right angle.

The interconnecting means serves to securely join the arm braces associated with the forearm and upper arm and allows the arm braces to pivot relative to each other. As described in more detail below, the interconnecting means is typically comprised of a combination of bolt, washer and T-nut, each of plastic construction.

The sleeves 11 of the device are each directly or indirectly attached at one end to either of the pair of arm braces overlaying the inside portions of the forearm and upper arm. The sleeves may be prepared from one or more of several known materials which may be used to form an annular component by securing means attached thereto, at least of portion of which has the capability of being stretched circumferentially to facilitate reception of the player's arm in the opening and to thereafter provide a snug fit on the arm. Typically, the sleeves may comprise stretchable or webbed materials such as elastic, rubber, nylon, or any combination thereof. In order that the sleeves may accommodate various arm sizes, the length of the sleeves should be such as to allow the ends of the sleeves to be joined together at various points. Typically, the sleeves are from 1 to 2 inches wide and 8 to 12 inches long. A 1 inch to 3 inch margin at one end may be used for overlap to allow for formation of the annular shape of the sleeve.

The sleeves may be maintained in position around the player's arm by securing means such as straps provided on the ends of the sleeves to secure a first end of the sleeve to a second end of the sleeve. Releasable fasteners may also be used to attach the ends of the sleeve to provide the annular structure. Releasable or separable fasteners of the loop and hook type commonly marketed under the trademark Velcro® may be used. The structure of such strips and the means by which they cooperate in fastening the components together is readily apparent from U.S. Pat. Nos. 2,717,437; 2,933,797; 2,083,737; 3,009,235; and 3,154,837. The loop strip has a pile composed of a plurality of closely arranged hooks that become entangled with the loops when the piles of the strips are brought into facial contact to fasten the strips together. The arrangement when the piles of the strips are pressed together is such as to present a substantial resistance to separation by forces parallel to the plane of facial contact between the hooked and looped strips, while presenting little resistance to separation of the piles by forces that tend to peal one strip away from the other.

Figure 2:
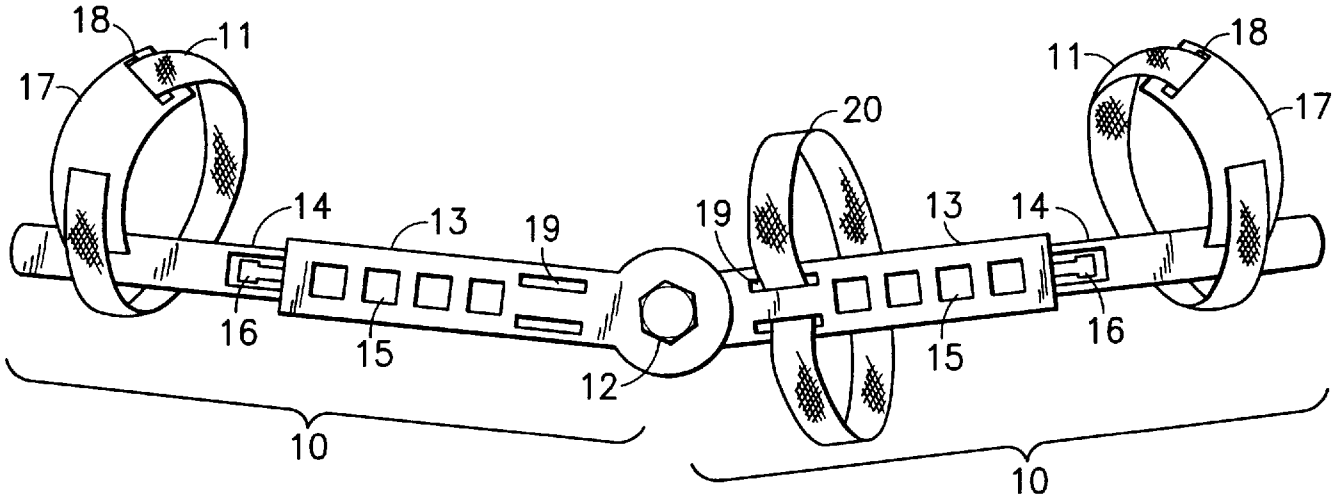
FIG. 2 is an elevated view of a preferred embodiment of the device.

In the preferred embodiment of FIG. 2, each arm brace comprises two components: an arm base component 13 and an arm extension component 14, wherein the arm extension component is adapted to be adjustably and securely connected to the arm base component. Each arm extension component is adjustably secured to the arm base component with which it is associated in a manner which permits the overall combined length of the arm extension and arm base components to be adjusted so as to comfortably conform to the respective lengths of the wearer's forearm and upper arm. Optionally, only one of the arm braces associated with the forearm and upper arm comprises the two component adjustable construction, with the other arm brace comprising the aforementioned unitary construction.

The arm extension and arm base components may be prepared from one or more of several known metal or plastic materials, which may be the same or different. The arm base components of the device are prepared so as to receive the arm extensions for the forearm and upper arm at a first end, and at a second end the interconnecting means 12 that serves to allow the arm base components to pivot over a predetermined range of motion during use of the device. The arm base components are typically 4 inches to 6 inches long and 1 inches to 2 inches wide.

The arm base components are prepared so as to receive the corresponding arm extensions in an adjustable fashion and in a manner that prevents those elements from becoming unconnected or loosened during use. The arm base components comprise toward a first end a plurality of openings 15 of uniform size and shape such that a button 16 attached to the arm extension which is under spring tension may be snugly and securely received into any of said openings to adjustably secure the arm extension to the arm base component. A second end of the arm base component opposite that containing the plurality of openings contains a single opening, preferably about ⅜ inches in diameter, through which the interconnecting means is placed and by which the arm base components and the arm extension components attached thereto are pivotally connected.

The components forming the interconnecting means at the point at which the first and second arm base components are joined preferably comprise a plastic bolt, a teflon washer and a plastic T-nut. The T-nut is fit in a recessed arrangement into an opening at the connecting end of the arm base components, and the plastic bolt is fit through and inserted into the washer and T-nut from the side opposite that through which the T-nut is placed. The bolt is preferably about a 1¼ inch×⅜ inch bolt, and the washer is preferably of ⅜ inch diameter. The plastic T-nut is preferably about ¾ inch long and contains a ⅜ inch opening to receive the plastic bolt.

In the preferred embodiment of FIG. 2, each of the sleeves 11 containing a stretchable or webbed component is securely fastened to the respective arm brace by means of an arm cup 17. The arm cups are rigid curved elements which are securely attached at one end to each arm extension by, for example, riveting or welding, and are free standing at the opposite end, wherein a slot 18 is provided for receiving the stretchable portion of the sleeve component. At the end of the arm cup at which the slot for the stretchable material is provided, a rectangular strip of material having a looped pile is attached to the underside of the arm cup by means, for example, of an adhesive. The strip is designed to cooperate with a second rectangular strip in releasably fastening the arm cup to the stretchable component of the sleeve. The second rectangular strip has a hooked pile and is securely fastened to the outer side face of the stretchable component, for example by means of a glue or stitching. Loop and hook strips may similarly be used in alternative sleeve component designs that do not include arm cup components.

In the preferred embodiment of FIG. 2, one or both of the arm braces of the device may also comprise a pair of slot openings 19 into which an arm strap 20 for preventing lateral movement is received. The arm strap, which is attached to slot openings in the arm brace and to the shooter's non-shooting arm, prevents the player's shooting arm from swinging away from the non-shooting arm during the shooting motion.

The lateral movement prevention strap of FIG. 2 may be made, for example, of nylon webbing and may comprise two segments sewn together so as to form a "Y" configuration containing a loop at one end. The main segment is typically about 24 inches long, and the smaller segment about 8 inches long. The smaller segment is sewn to the longer segment at a point about 16 inches from one end of the longer segment. Each end of the loop may contain hook and loop fasteners attached thereto for snugly securing one end of the strap to the player's non-shooting arm. The opposite end of the strap also may have hook and loop fasteners attached thereto for inserting through the slot openings in the arm brace on the player's shooting arm and attaching the end of the strap thereto. The lateral movement prevention strap may be adjusted to comfortably suit the body frame size of the player.

Figure 3:
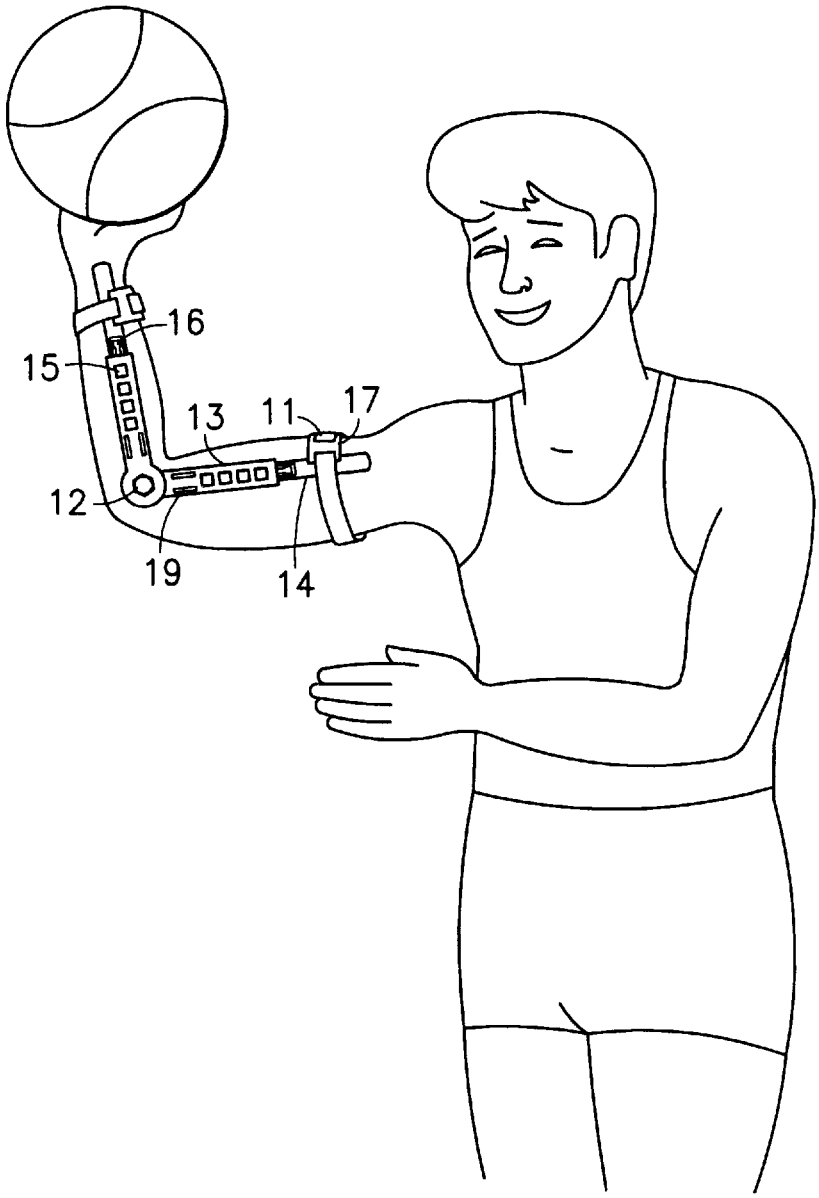
FIG. 3 is an isometric view showing the training device as attached to the shooting arm of a basketball player at the point at which the ball is projected toward the basket.

FIG. 3 illustrates a preferred method of using the training aid or device. As shown therein, a sleeve component is arranged on each of the forearm and upper arm of the shooting arm of the basketball player. When properly arranged, the sleeve components are oriented so that the attached arm brace will overlay the inside portions of the forearm and upper arm, respectively. This permits the player to comfortably support the basketball on the fingers of the shooting arm as the forearm is brought back toward the body, but not beyond the point at which a right angle is formed with the upper arm, and then forward toward the basket as the ball is projected toward the target. Any action by the player to move the forearm beyond the point at which an "L" is formed by the forearm and upper arm is met by mechanical resistance supplied by the positive stop provided by contact of the first and second arm braces adjacent the interconnecting means, which serves to signal the player that the arm is in the proper shooting position. Similarly, any action by the player to swing the elbow of the shooting arm away from the non-shooting arm will be met with resistance by the attachment of the lateral movement prevention strap, which serves to signal the player that the elbow of the shooting arm is moving away from the non-shooting arm and into an improper position. After continuous use of the device, maintenance of the forearm at a right angle with the upper arm and the elbow of the shooting arm in close lateral proximity to the non-shooting arm during the shooting motion becomes a learned skill.

While only one embodiment of this invention has been shown and described by way of illustration, many modifications will occur to those skilled in the art and it is therefore desired that it be understood that it is intended herein to cover all such modifications that fall within the true spirit and scope of this invention.

What is claimed is:

1. A training device for developing proper shooting technique by a basketball player comprising first and second sleeves that are adapted to snugly fit on the forearm and upper arm, respectively, of the shooting arm of the player: first and second arm braces to which the first and second sleeves are respectively attached; an arm strap secured to at least one arm brace at a first end and adapted to be secured to the non-shooting arm of the player at a second end; and an interconnecting means pivotally connecting the first and second arm braces, wherein the pivoting movement of the first arm brace relative to the second arm brace is limited by mechanical resistance provided at the point at which the first arm brace contacts and forms a right angle with the second arm brace.

2. The training device of claim 1 wherein the sleeves are comprised of a material selected from the group consisting of stretchable and webbedmaterials.

3. The training device of claim 2 wherein the sleeves further comprise one or more loop and hook fasteners for releasably connecting the ends of the sleeves.

4. The training device of claim 1 further comprising arm cups secured to the first and second arm braces at a first end and to which a stretchable material is attached at a second end to form the first and second sleeves.

5. A training device for developing proper shooting technique by a basketball player comprising first and second sleeves that are adapted to snugly fit on the forearm and upper arm, respectively, of the shooting arm of the player; first and second arm braces to which the first and second sleeves are respectively attached, wherein at least one of said first and second arm braces comprises an arm base component and an arm extension component, the arm extension component being adjustably connected to the arm base component; an arm strap secured to at least one arm base component at a first end and adapted to be secured to the non-shooting arm of the player at a second end; and an interconnecting means pivotally connecting the first and second arm braces, wherein the pivoting movement of the first arm brace relative to the second arm brace is limited by mechanical resistance provided at the point at which the first arm brace contacts and forms a right angle with the second arm brace.

6. The training device of claim 5 wherein the sleeves are comprised of a material selected from the group consisting of stretchable and webbed materials.

7. The training device of claim 6 herein the sleeves further comprise one or more loop and hook fasteners for releasably connecting the ends of the sleeves.

8. The training device of claim 5 further comprising arm cups secured to each arm extension component at a first end and to which a stretchable material is attached at a second end to form the first and second sleeves.

9. A method of using a training device for basketball players characterized by first and second sleeves associated with first and second arm braces pivotally connected by an interconnecting means, wherein the pivoting movement of the first arm brace relative to the second arm brace is limited by mechanical resistance provided at the point at which the first arm brace forms a right angle with the second arm brace, said method comprising the steps of:

a) manually placing the first sleeve to which a first arm brace is attached on the forearm of the shooting arm of the player;

b) manually placing the second sleeve to which a second arm brace is attached on the upper arm of the shooting arm of the player;

c) securing the ends of each of the first and second sleeves together by means of a first and second securing means;

d) securing an arm strap to at least one arm brace at a first end and the player's non-shooting arm at a second end by means of third and fourth securing means; and e) moving the shooting arm in which a basketball is held to a point at which the first and second arm braces pivot about an interconnecting means to a point at which the first arm brace contacts the second arm brace to thereby provide resistance to further movement and signal to the player the proper arm alignment for shooting a basketball.

10. The method of claim 9 wherein at least one arm brace comprises an arm base component and an arm extension component.

11. The method of claim 9 wherein the sleeves are comprised of a material selected from the group consisting of stretchable and webbed materials.

12. The method of claim 11 wherein one or both of the sleeves further comprise one or more loop and hook fasteners for releasably connecting the ends of the sleeves.

13. The method of claim 9 wherein at least one of the arm braces further comprises an arm cup secured to the arm brace at a first end and to which a stretchable material is attached at a second end to from the first and second sleeves.

* * * * *